US005248103A

United States Patent [19]

Polnik

[11] Patent Number: 5,248,103

[45] Date of Patent: Sep. 28, 1993

[54] METHOD AND APPARATUS FOR FEEDING AND CLAMPING THREAD IN A THREAD WINDING DEVICE FOR TEXTILE MACHINES

[75] Inventor: Arthur Polnik, Viersen, Fed. Rep. of Germany

[73] Assignee: Palitex Project-Company GmbH, Krefeld, Fed. Rep. of Germany

[21] Appl. No.: 775,687

[22] Filed: Oct. 10, 1991

[30] Foreign Application Priority Data

Oct. 30, 1990 [DE] Fed. Rep. of Germany ..... 4034482

[51] Int. Cl.[5] ..... B65H 54/00

[52] U.S. Cl. ..... 242/18 PW

[58] Field of Search ..... 242/18 PW, 355 A; 57/261, 263, 269, 270, 279, 313

[56] References Cited

U.S. PATENT DOCUMENTS

| | | | |
|---|---|---|---|
| 3,730,447 | 5/1973 | Franzen et al. | 242/18 PW |
| 4,299,357 | 11/1981 | Munker | 242/18 PW X |
| 4,591,105 | 5/1986 | Niederer | 242/18 PW X |
| 4,595,151 | 6/1986 | Slavik et al. | 242/18 PW X |
| 4,603,818 | 8/1986 | Luz et al. | 242/18 PW X |
| 4,852,823 | 8/1989 | Adams et al. | 242/18 PW X |
| 4,878,629 | 11/1989 | Grecksch et al. | 242/18 PW |
| 5,005,776 | 4/1991 | Schwarz | 242/18 PW |

FOREIGN PATENT DOCUMENTS

| | | |
|---|---|---|
| 2312609 | 3/1973 | Fed. Rep. of Germany . |
| 2536477 | 8/1975 | Fed. Rep. of Germany . |
| 2711024 | 3/1977 | Fed. Rep. of Germany . |

*Primary Examiner*—Daniel P. Stodola
*Assistant Examiner*—Michael R. Mansen
*Attorney, Agent, or Firm*—Robert W. Becker & Associates

[57] ABSTRACT

A method and a device for feeding and clamping a thread in a thread winding device for textile machines are provided. The thread winding device comprises a bobbin frame with two legs to which two centering disks are rotatably connected. Between the centering disks the bobbins are received. One of the centering disks is outwardly pivotable together with the leg it is attached to against the force of a spring. The other centering disk is tiltably mounted at the respective leg of the bobbin frame. The feeding of the beginning of the thread to the bobbin is carried out via a forked gripping arm. One of the arms of the fork carries a clamping element for the beginning of the thread while the other arm is provided with an auxiliary roller. The gripping arm approaches the centering disk such that the auxiliary roller contacts the outer surface of the centering disk at an edge thereof and a lateral pressure is exerted onto the centering disk which results in a tilting movement of the centering disk. Due to the tilting movement a slot is created between the bobbin and the centering disk into which the beginning of the thread is automatically inserted. After the retraction of the auxiliary roller the slot is closed so that the beginning of the thread is clamped between the bobbin and the centering disk. Subsequently, the winding process starts.

10 Claims, 5 Drawing Sheets

METHOD AND APPARATUS FOR FEEDING AND CLAMPING THREAD IN A THREAD WINDING DEVICE FOR TEXTILE MACHINES

BACKGROUND OF THE INVENTION

The present invention relates to a method for feeding and clamping thread in a thread winding device for textile machines. The thread winding device has a U-shaped bobbin frame with a first and a second centering disks for receiving bobbins. The centering disks are mounted to free ends of the legs of the U-shaped bobbin frame such that inwardly oriented faces of the centering disks are facing each other and are rotatable about a centering axis extending through the first and the second centering disks. At least a first centering disk is tiltable about two axis that are perpendicular to one another and to the centering axis and at least the second centering disk is slidable against the force of a spring in an outward direction relative to the U-shaped frame. The bobbin inserted into the U-shaped bobbin frame is axially moved in an outward direction together with the second centering disk so that between the first centering disk and the bobbin a slot is created into which the beginning of the thread is introduced and clamped by returning the bobbin and the second centering disk into their starting position.

The described method is usually carried out by hand in known apparatuses of the aforementioned kind.

The manual feeding of the beginning of the thread, for example, in a double-twisting machine, is started by introducing the beginning of the thread into a notch of a specially prepared bobbin or, as mentioned above, is introduced into a space between the end of the bobbin and the face of the centering disk facing the bobbin. The operating personnel opens the bobbin frame by hand, moves the bobbin to one side and inserts the thread into the clamping slot between the bobbin and the centering disk. Auxiliary devices for such manually performed methods are not necessary.

With the apparatus known from DE-OS 23 12 609 the beginning of the thread is changed between the centering disk and the bobbin by hand. With the known apparatus no auxiliary devices are therefore required. However, an automatic feeding of the beginning of the thread is impossible.

A thread winding device with the aforementioned features is known and, for example, described in DE-PS 27 11 024. In this known device, the beginning of the thread is moved by a gripping arm into the vicinity of a bobbin that is provided with holes. A suction line is provided within the bobbin frame and air is sucked via openings provided at the face of the centering disk from the interior of the bobbin. Due to the stream of air which is flowing from the outside through the holes into the interior of the bobbin, the beginning of the thread is sucked into the interior and held in place so that, when rotating the bobbin, the following thread portions may be wound up.

The described device has the disadvantage that a number of complicated auxiliary devices must be provided at the thread winding device and, furthermore, that the bobbins must be provided with holes.

A device for clamping the beginning of the thread within the area of the centering disks that are disposed at a bobbin frame and receive a bobbin, is described in DE-PS 25 36 477 whereby one of the centering disks is provided with a groove extending in the circumferential direction. The groove is provided with paired thread clamps. These thread clamps are in the form of notches that extend towards the bottom of the groove within the sidewalls of the groove in the direction of rotation of the centering disk and also against the direction of rotation. The inwardly directed side walls within the area of each individual clamp pair (notches) are provided with undercut catches that are oriented in the direction of rotation of the centering disk. With this device, the beginning of the thread is fastened directly to the centering disk and in this case further auxiliary devices are required at the centering disk.

The problem to be solved by the present invention lies in the fact that, on the one hand, the imitation of the manually performed introduction of the beginning of the thread to the respective thread winding device results in an extraordinarily complicated feeding device and, on the other hand, the known devices for an automatic thread feeding and subsequent clamping require complicated auxiliary devices at the thread winding device itself.

It is therefore an object of the present invention to improve the aforementioned methods for feeding and clamping threads in a thread winding device so that an automatic feeding and clamping of the beginning of the thread is possible without the need for complicated auxiliary devices at the thread winding device. This means that the thread winding device should not be provided with any further components which are not commonly present in known thread winding devices.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
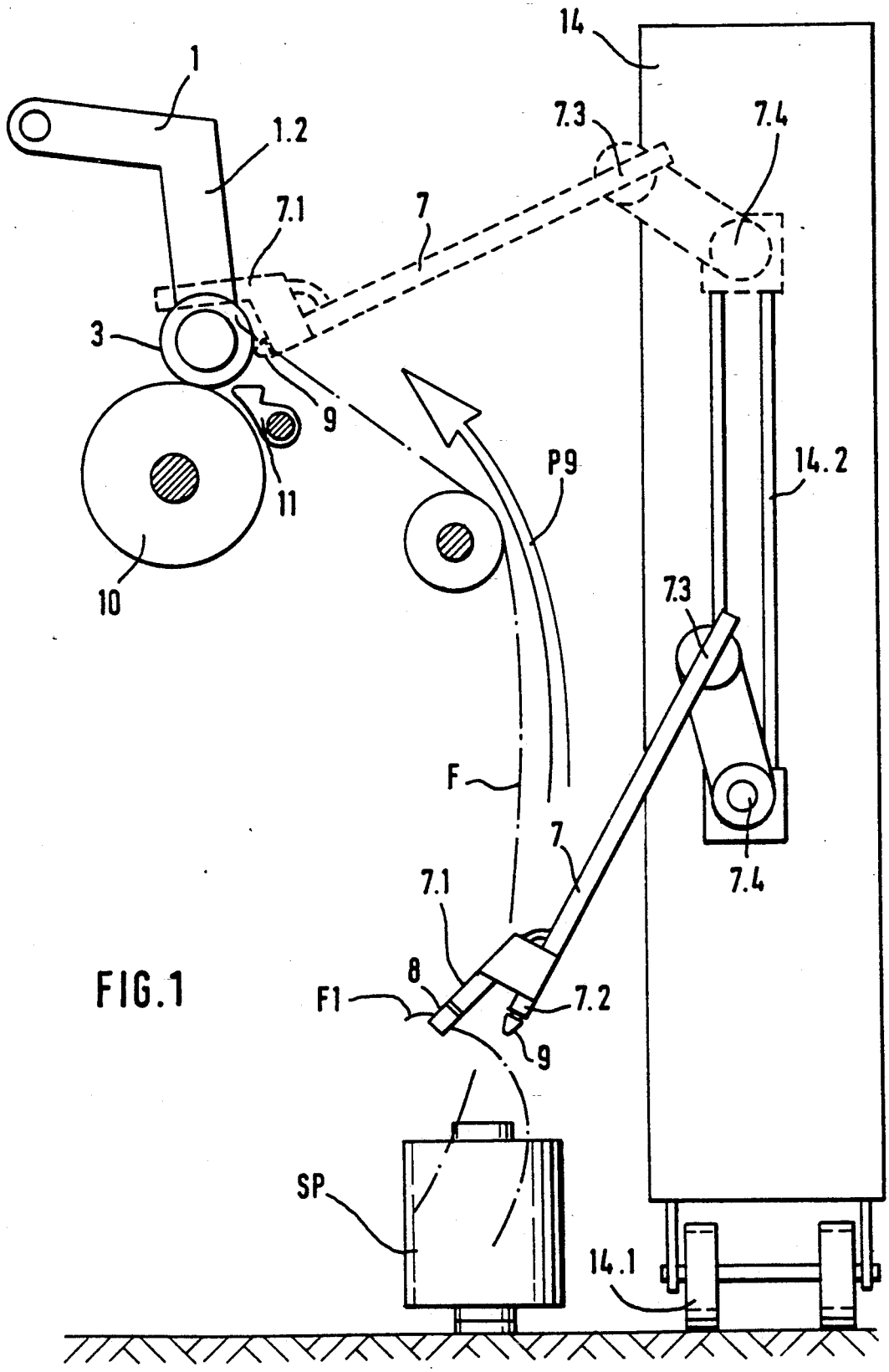
FIG. 1 is a schematic representation in a vertical cross-sectional view of a thread winding device of a textile machine (not represented in the drawing) with a respective control unit.

The method of the present invention is primarily characterized by the following steps: receiving a bobbin between inwardly oriented faces of the first and second centering disks in an initial centered position; contacting an outwardly oriented face of the first centering disk with a gripping arm; exerting pressure with the gripping arm parallel to an axis of a bobbin on an edge of the outwardly oriented face of the first centering disk, thereby tilting the first centering disk, sliding a bobbin together with the second centering disk in an axial direction away from the first centering disk and creating a slot between the inwardly oriented face of the first centering disk and a bobbin; inserting a thread into the created slot with the gripping arm; and releasing the pressure exerted on the edge of the outwardly oriented face of the first centering disk, thereby returning a bobbin and the second centering disk into the initial centered position, closing the slot and clamping a thread between the inwardly oriented face of the first centering disk and a bobbin.

Preferably, the gripping arm contacts the outwardly oriented face of the first centering disk at a collar provided thereat, whereby the collar radially extends past an outer perimeter of a bobbin.

The feeding device for a thread winding device of textile machines according to the present invention comprises: a U-shaped bobbin frame with a first and a second legs; a first and a second centering disks faceing one another, connected to the first and second legs, respectively, at free ends thereof and rotatable about a centering axis extending through said first and second centering disks, for receiving a bobbin, with at least the first centering disk being tiltable about two axes that are perpendicular to one another and to the centering axis, and with at least the second centering disk being slidable against an elastic force in an outward direction relative to the U-shaped frame; a collar provided at at least the first centering disk extending in a radial direction past a bobbin; and a gripping arm for feeding thread to a bobbin, the gripping arm comprising a forked end with a first arm having a clamping element for holding a beginning of a thread and with a second arm having an auxiliary element for exerting pressure on the first centering disk, whereby a distance between the clamping element and the auxiliary element correspond to a sum of a diameter of a bobbin and a friction of a radial width of the collar.

In a preferred embodiment the auxiliary element is in the form of an auxiliary roller. Furthermore, the collar has an outwardly oriented surface that is conical and the auxiliary roller has a conical mating surfaces for contacting the collar.

In another embodiment the second arm of the forked end is extendable. It is expedient that the second leg of the U-shaped frame is pivotable against the elastic force in the outward direction.

In a further embodiment at least the first centering disk is connected to the first leg of the U-shaped frame by a ball joint. It is also possible to provide this connection in the form of self-aligning ball bearing.

In another embodiment the auxiliary element is movable in a plane that is perpendicular to a plane formed by the first and second arms of the forked end. The forked end may be pivotable. It is expedient to connect the gripping arm via a multiple joint system to a control unit.

The gist of the invention lies in the fact that at least one of the centering disks is provided with a cardanic suspension at the bobbin frame so that the respective centering disk may not only perform a rotational movement about the centering axis but also may carry out tilting or swivel movements about the axes that are perpendicular to one another and are provided in one plane that is perpendicular to the centering axis. The respective other centering disk is then slidable against an elastic force; i.e., a spring, in the direction of the centering axis in an outward movement relative to the bobbin frame. The inventive embodiment provides the possibility to swivel or tilt the tiltable centering disk about a predetermined angle by exerting pressure onto its outer edge and at the same time slide the bobbin into its axial direction. Consequently, the position diametrically opposed to the point of exerted pressure at the centering disk, a slot, more or less wide, is provided between the end of the bobbin and the inwardly oriented face of the centering disk into which the thread may be introduced by the gripping arm. When the pressure is released the bobbin is returned into its initial centered position due to the elastic force exerted in an axial direction and the thread is then clamped between the end of the bobbin and the centering disk.

The auxiliary element necessary to effect the tilting of the centering disk is provided at the forked end of the gripping arm, whereby the distance between the auxiliary element and the clamping element of the gripping arm is selected such that when the gripping arm approaches the centering disk the auxiliary element and the clamping element are automatically correctly positioned so that simultaneous to the tilting of the centering disk the beginning of the thread is introduced into the resulting slot.

The axial slidability of the second centering disk may be accomplished in many known ways, for example, the centering disk may be disposed at a leg of the bobbin frame which is pivotable against an elastic force, i.e., a spring in an outwardly directed movement. The tilting or swiveling action of the other centering disk may be achieved by providing a ball joint at the connection of the centering disk to the bobbin frame. It is also conceivable that the centering disk is supported by a ball bearing the inner ring of which is then basically provided as a cardanic suspension at the respective leg of the bobbin frame. The centering disk may also be supported by a self-aligning ball bearing.

The inventive method and the inventive device provide in a simple manner and without any complicated auxiliary devices an automatic feeding of the beginning of a thread to a thread winding device with a subsequent automatic clamping action.

DESCRIPTION OF PREFERRED EMBODIMENTS

The present invention will now be described in detail with the aid of several specific embodiments utilizing FIGS. 1 through 8.

FIG. 1 shows a schematic representation of a thread winding device in which a thread F is fed from a feeding spool SP to a thread winding device which comprises essentially a U-shaped bobbin frame 1 with two legs 1.1 and 1.2 (see FIG. 5), at free ends of which centering disks 2 and 3 are provided between which the bobbin 4 may be inserted and onto which the thread F will be wound.

Figure 7:
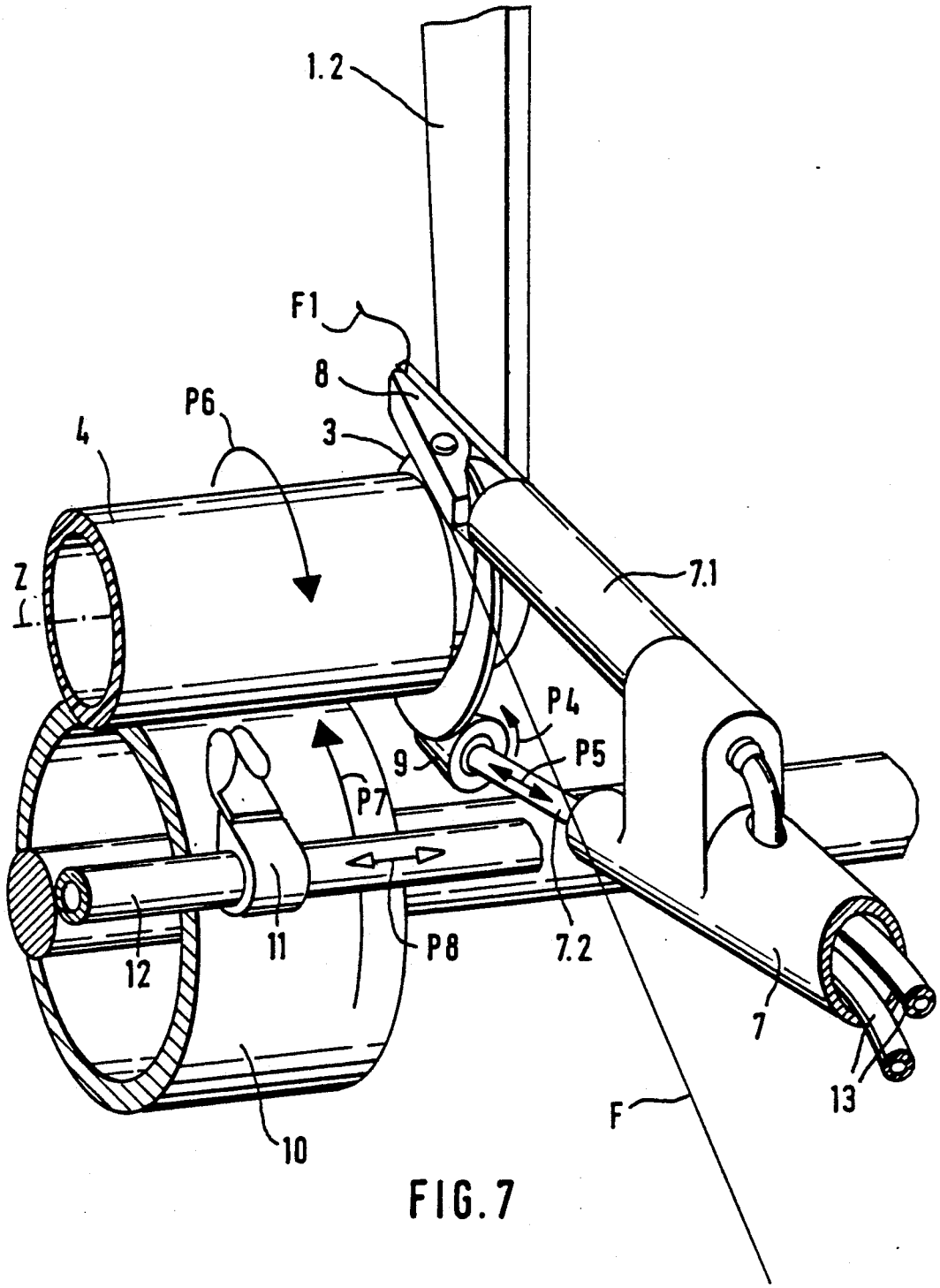
FIG. 7 is a perspective detailed view of the thread winding device according to FIGS. 1 to 6 in the area of a centering disk during the thread feed.
Figure 8:
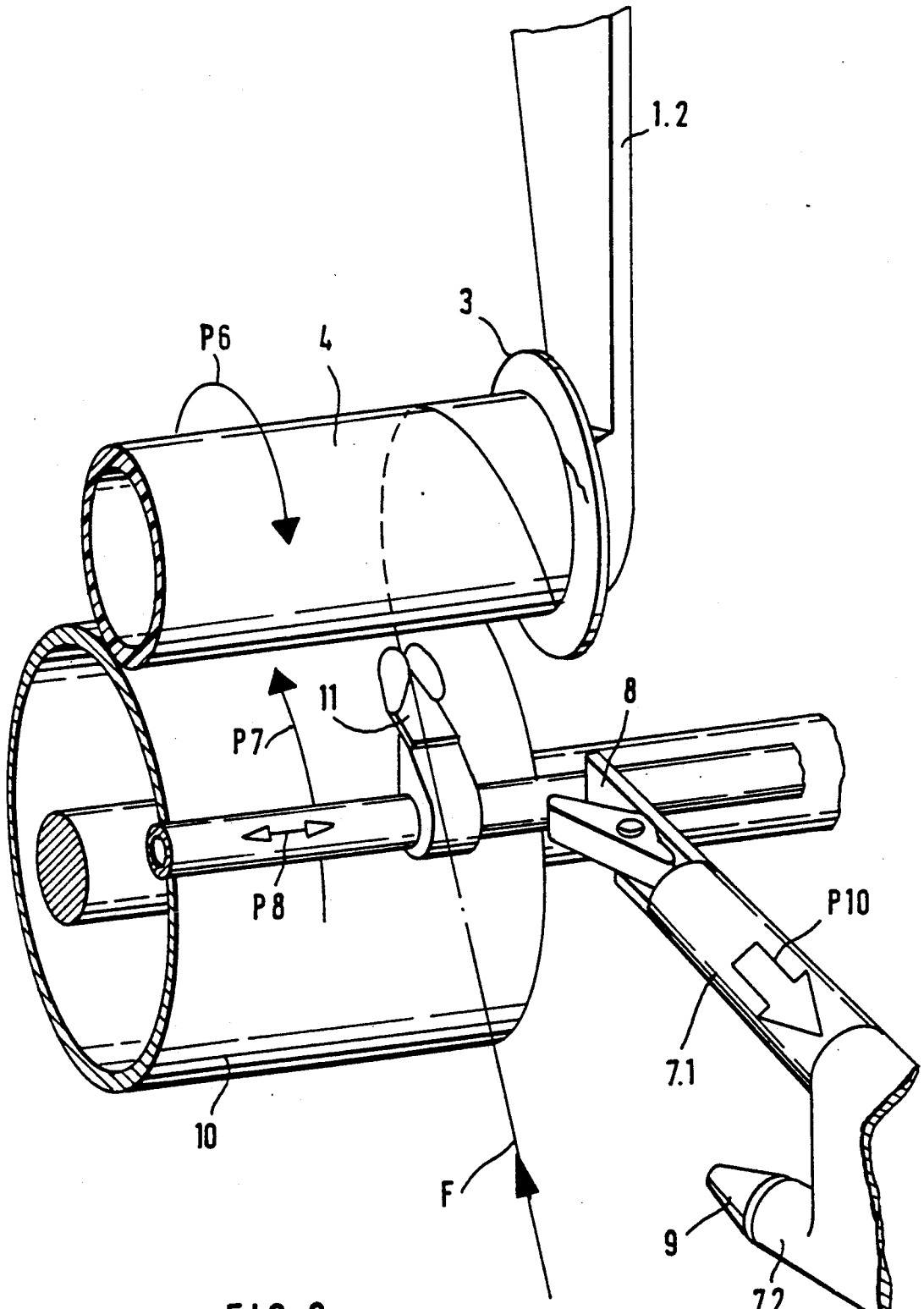
FIG. 8 shows a perspective detailed view according to FIG. 7 after the thread feed.

As can be seen from FIGS. 7 and 8 the bobbins 4 rotate in the direction of the arrow P6 during the winding step and are driven by a driving shaft which rotates in the direction of the arrow P7, whereby the thread F, after the feeding and clamping step which will be discussed in detail in the following paragraphs, is fed via a reciprocating thread guide 11 positioned at a guide rod 12 and moving in the direction of the arrow P8. Further driving elements which are essentially known in the art are not represented.

The feeding and clamping of the beginning of the thread is performed by a control unit 14 which is movable by rollers 14.1 and which is provided with a gripping arm 7. The gripping arm 7 is guided by a plurality of joints 7.3 and 7.4 within a vertical guide 14.2 and its free end its forked. The forked end comprises an arm 7.1 which has a clamping element 8 and a further arm 7.2 which is provided with an extendable auxiliary roller 9. The auxiliary roller 9 (FIG. 6) has a conical mantle surface 9.1 and is supported at the arm 7.2 by a ball bearing 9.2.

The centering disks 2 and 3 are provided with a respective collar 3.1 at their outwardly oriented faces. The collar has a conical surface. The inner surface of the centering disks 2 and 3 have a respective centering projection 3.2 for receiving the bobbins 4.

Figure 5:
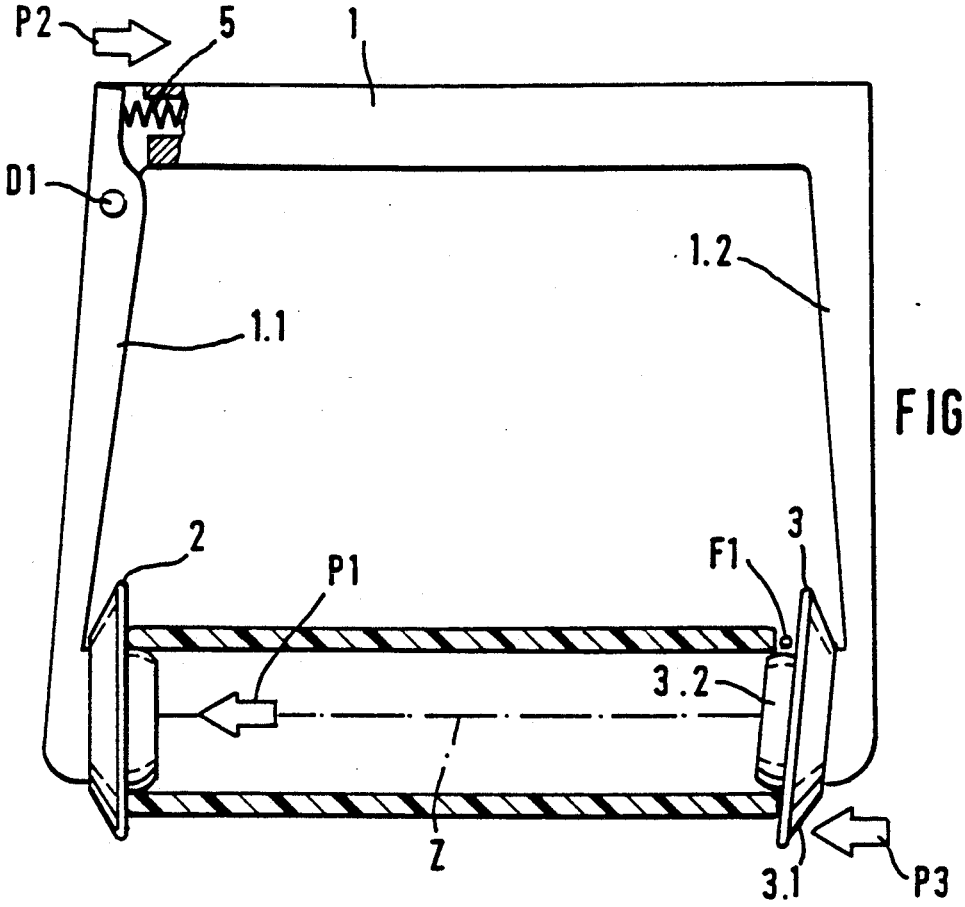
FIG. 5 shows a top view of the bobbin frame of the thread winding device according to FIG. 1.
Figure 6:
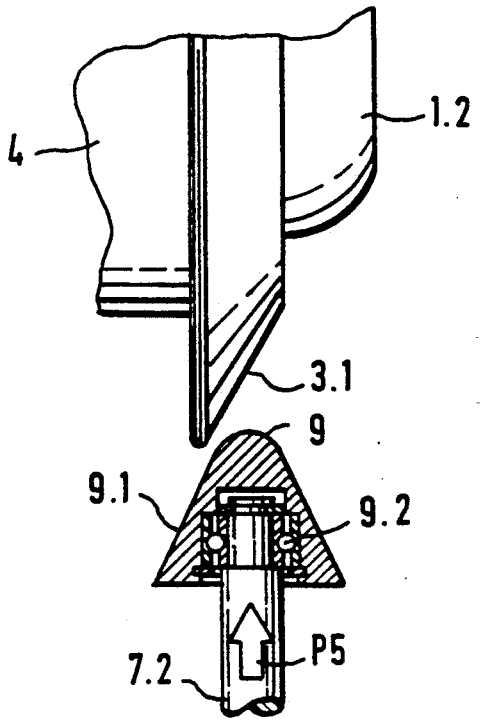
FIG. 6 shows a detail of a centering disk of the device according to FIG. 5 in a top view.

The left centering disk 2, represented an FIG. 5, is rotatably supported at the arm 1.1 of the bobbin frame 1. The bobbin frame arm 1.1 is pivotably supported at the bobbin frame 1 at the pivoting point D1. The outward pivoting movement in the direction of the arrow P1 is carried out against the force of a pressure spring 5 disposed at the bobbin frame 1, whereby the pressure spring 5 is compressed in the direction of the arrow P2 due to the pivoting movement.

Figure 2:
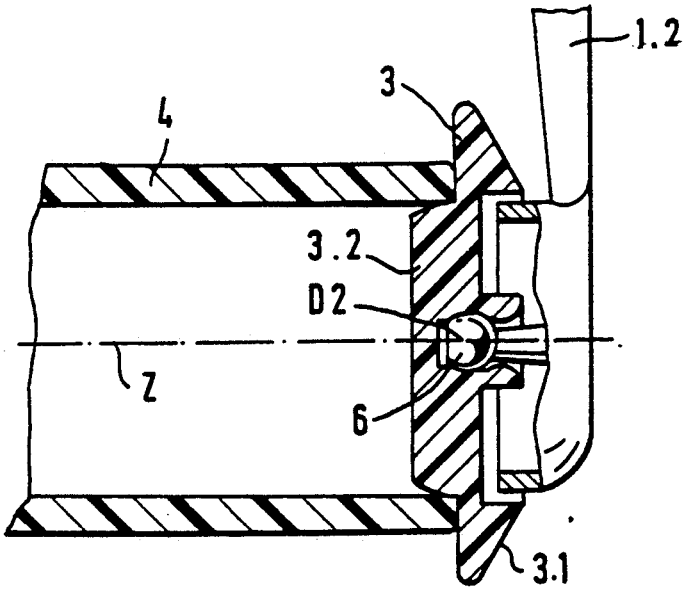
FIG. 2 shows an enlarged detail of the thread winding device according to FIG. 1 in the area of the centering disk.
Figure 3:
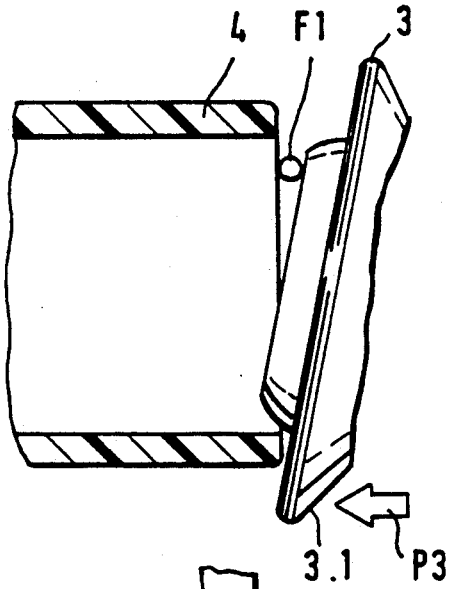
FIG. 3 shows the thread winding device according to FIG. 1 with a different tilt of the centering disk.
Figure 4:
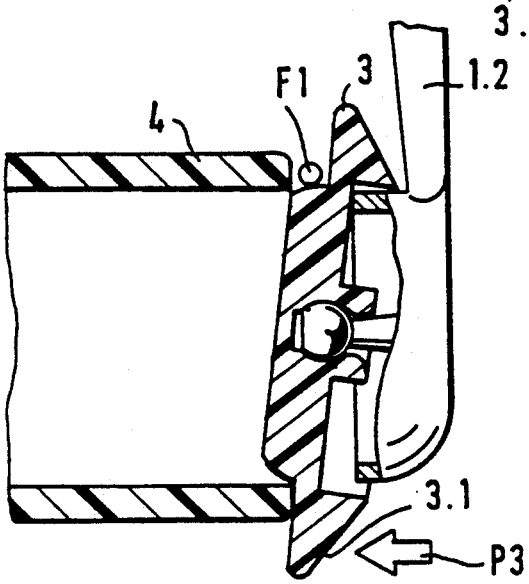
FIG. 4 shows the thread winding device according to FIG. 2 at another angle of tilt.

The right centering disk 3, represented in FIG. 5 and in FIGS. 2 to 4, is connected to the bobbin frame arm 1.2 via a ball joint 6 so that the centering disk is not only rotatable about the centering axis Z but at the same time tiltable about two axes extending through the point of rotation D2 which are perpendicular relative to one another and perpendicular to the centering axis Z.

The feeding and clamping of a beginning of a thread will be described in detail in the following paragraphs.

As can be seen from FIG. 1 the beginning of the thread F is gripped by the clamping element 8 of the gripping arm 7 and is moved in an upward direction (indicated by the arrow P9) towards the right centering disk 3 of the thread winding device. The forked end of the gripping arm 7 comprising the arms 7.1 and 7.2 approaches the centering disk 3 in the manner shown in FIG. 7. The auxiliary roller 9 is extended in the direction of the arrow P5 and contacts with its conical outer mantle surface 9.1 the conical surface of the collar 3.1 of the centering disk 3. Due to the conical embodiment of the auxiliary roller 9 and the collar 3.1 a pressure is exerted onto the lower edge of the collar 3.1 in the direction of the arrow P3. This pressure may also be exerted by a respective lateral movement of the gripping arm 7 or a slight tilting about the longitudinal axis of the gripping arm 7. This is represented in FIGS. 3 and 4 respectively, whereby, in order to facilitate the drawings, the auxiliary roller 9 is not represented. The exerted pressure which acts parallel to the centering axis Z tilts the centering disk 3 about its pivoting axis whereby the bobbin 4 is moved in the direction of the arrow P1 (FIG. 5) towards the centering disk 2 so that thereby the leg 1.1 of the bobbin frame is moved outwardly against the force of the pressure spring 5. As can be seen in the FIGS. 3, 4, 5, at the upper edge of the centering disk 3 between the end of the bobbin 4 and the inwardly oriented phase of the centering disk 3 a slot, more or less wide, is created into which the beginning of the thread F1 is inserted via the clamping element 8. FIGS. 3 and 4 differ from one another only by the size of the selected slot width. It should be noted that during this process the bobbin 4 together with the two centering disks 2 and 3 are already driven by the driving shaft 10 and that the auxiliary roller 9 due to its rotatable support also follows this rotation. As soon as the lateral pressure in the direction of the arrow P3 is released by moving the auxiliary roller 9 back, the slot at the upper edge between the end of the bobbin 4 and the inner face of the centering disk 3 is closed due to the force of the spring 5 which acts onto the leg 1.1 of the bobbin frame thus sliding the bobbin 4 back into its initial position. The beginning of the thread F1 is now clamped. The clamping element 8 may now be opened and the winding process starts immediately. As can be seen in FIG. 8 the gripping arm 7 is returned in the direction of the arrow P10.

The actuating mechanisms in the front part of the gripping arm 7 for extending and retracting the auxiliary roller 9 and for actuating the clamping element 8 are not represented in the drawings. They are actuated via lines 13.

The present invention is, of course, in no way restricted to the specific disclosure of the specification and drawings, but also encompasses any modifications within the scope of the appended claims.

What I claim is:

1. A method for feeding and clamping thread in a thread winding device for textile machines, said thread winding device having a U-shaped bobbin frame with a first and a second rotatable centering disk for receiving bobbins being connected to free ends of legs of said U-shaped bobbin frame such that inwardly oriented faces of said centering disks are facing each other, said method comprising the steps of:

receiving a bobbin between said inwardly oriented faces of said first and said second centering disks in an initial centered position;

contacting an outwardly oriented face of said first centering disk with a gripping arm;

exerting pressure with said gripping arm parallel to an axis of said bobbin on an edge of said outwardly oriented face of said first centering disk, thereby tilting said first centering disk, sliding said bobbin together with said second centering disk in an axial direction away from said first centering disk and creating a slot between said inwardly oriented face of said first centering disk and said bobbin;

inserting a thread into said created slot with said gripping arm; and releasing the pressure exerted on said edge of said outwardly oriented face of said first centering disk, thereby returning said bobbin and said second centering disk into said initial centered position, closing said slot and clamping a thread between said inwardly oriented face of said first centering disk and said bobbin.

2. A method according to claim 1, wherein said gripping arm contacts said outwardly oriented face of said first centering disk at a collar provided thereat, said collar radially extending past an outer perimeter of said bobbin.

3. A feeding device for a thread winding device of textile machines, comprising:

a U-shaped bobbin frame with a first and a second leg;

a first and a second centering disk facing one another, connected to said first and second legs, respectively, at free ends thereof and rotatable about a centering axis extending through said first and second centering disks, said first and said second centering disks serving for receiving a bobbin, with at least said first centering disk being tiltable about two axes that are perpendicular to one another and to said centering axis, and with at least said second centering disk being slidable against an elastic force in an outward direction relative to said U-shaped frame;

a collar provided at at least said first centering disk extending in a radial direction past said bobbin; and a gripping arm for feeding thread to said bobbin, said gripping arm comprising a forked end with a first arm having a clamping element for holding a beginning of thread and with a second arm having an auxiliary element for exerting pressure on said first centering disk, with a distance between said clamping element and said auxiliary element equal to a sum of a diameter of said bobbin and a fraction of a radial width of said collar.

4. A feeding device according to claim 3, wherein said auxiliary element is a roller.

5. A feeding device according to claim 4, wherein said collar has an outwardly oriented surface that is conical and said auxiliary roller has a conical mating surface for contacting said collar.

6. A feeding device according to claim 3, wherein said second arm of said forked end is extendable.

7. A feeding device according to claim 3, wherein said second leg of said U-shaped frame is pivotable against said elastic force in said outward direction.

8. A feeding device according to claim 3, wherein at least said first centering disk is connected to said first leg of said U-shaped frame by a ball joint.

9. A feeding device according to claim 3, wherein said auxiliary element is movable in a plane that is perpendicular to a plane formed by said first and second arms of said forked end.

10. A feeding device according to claim 3, wherein said gripping arm is connected to a control unit via a multiple joints.

* * * * *